US005290067A

United States Patent [19]

Langen

[11] Patent Number: 5,290,067

[45] Date of Patent: Mar. 1, 1994

[54] REPOSITIONAL WINDOW PRICING LABEL

[75] Inventor: Joseph W. Langen, Cheektowaga, N.Y.

[73] Assignee: Moore Business Forms, Inc., Grand Island, N.Y.

[21] Appl. No.: 820,375

[22] Filed: Jan. 14, 1992

[51] Int. Cl.[5] ..... B42D 15/00

[52] U.S. Cl. ..... 283/60.1; 40/594

[58] Field of Search ..... 283/60.1, 81, 94, 101, 283/100; 462/29, 26, 37, 40; 40/591, 592, 594

[56] References Cited

U.S. PATENT DOCUMENTS

| | | | |
|---|---|---|---|
| 2,110,768 | 3/1938 | Kellog | 40/643 |
| 2,603,899 | 7/1952 | Leander | 40/594 |
| 3,799,829 | 3/1974 | Heatwole | 156/235 |
| 4,671,003 | 6/1987 | Vitol | 40/2 R |
| 4,695,077 | 9/1987 | Pretre | 40/594 |
| 4,864,755 | 9/1989 | Owens | 40/594 |
| 4,882,211 | 11/1989 | McIntrye et al. | 428/40 |
| 4,889,754 | 12/1989 | Vargas | 428/41 |
| 4,895,747 | 1/1990 | Birkholz et al. | 428/42 |
| 4,940,258 | 7/1990 | Cuba | 283/81 |

OTHER PUBLICATIONS

QLS, Incorporated Brochure "Quadrel's Transform/1800 Forms Labeling System" 1988.

*Primary Examiner*—Mark Rosenbaum
*Assistant Examiner*—Willmon Fridie, Jr.
*Attorney, Agent, or Firm*—Nixon & Vanderhye

[57] ABSTRACT

A window sticker for pricing and fuel economy information about a motor vehicle can be readily positioned and repositioned on a motor vehicle window, and finally removed from the window without leaving an adhesive residue, and in integral form so that it serves as a customer receipt. A continuous web of coated hydrophobic bond paper, or printable plastic, is moved in a first direction to a press where fixed indicia, including fuel economy and price related word indicia, is applied to a first face of the web, and patterns of repositional adhesive are applied to the first face adjacent edges of the web elongated in the first direction. The repositional adhesive patterns are covered by release material strips to protect them. Application of the adhesive and protective strips may be accomplished simultaneously using tip-on or blow-on techniques with double faced adhesive label stock. Variable indicia is printed on the first face using a laser printer, including numerical indicia corresponding to and adjacent the fuel economy and price fixed word indicia. The individual stickers are burst from the continuous web, and if they contain marginal portions with tractor feed openings, the marginal portions are cut off.

18 Claims, 2 Drawing Sheets

REPOSITIONAL WINDOW PRICING LABEL

BACKGROUND AND SUMMARY OF THE INVENTION

The invention relates to window stickers for motor vehicles. One form of window sticker common in today's market is a sticker having a bond sheet with a water reactive starch based adhesive coating covering the entire sheet. The adhesive is wet, and then applied to a motor vehicle window. While this type of sticker is economical, it must be scraped from the window at the time of purchase, leaving adhesive residue on the window's surface, and completely destroying the label.

Another type of commonly used window sticker comprises a bond face sheet fully coated with a pressure sensitive removable adhesive adhered to a printed release liner, the printed release liner containing the necessary pricing and fuel economy information. By removing the border of the release liner, the label is affixed to the inside of a car window. This construction allows the dealer to remove the entire label, and separate the two plies, so that the customer may retain the printed release sheet for future reference. However this type of form is expensive, leaves an adhesive residue on the window surface, yellows at the exposed adhesive areas, delaminates from the window at high and low temperatures and humidity changes, and is easily ripped or removed from the window when the window is rolled open.

According to the present invention, a window sticker, a window sticker intermediate, and a method of constructing a window sticker, are provided which overcome the disadvantages discussed above, and additionally allow easy production of the window sticker utilizing continuous or sheet fed laser printers. According to the present invention, a sticker is provided which may be constructed simply and relatively inexpensively from bond paper, may be cleanly removed from a window with no adhesive residue remaining, and may be removed integrally so that the sticker may be retained by the customer as a receipt.

According to one aspect of the present invention, a window sticker is provided which comprises the following elements: A sheet of printable material having first and second faces, and opposite first and second edges, and opposite third and fourth edges. Indicia printed on the first face. Repositional adhesive patterns disposed on the first face adjacent the first and second edges. And, release strips covering the repositional adhesive patterns, and removable to expose the repositional adhesive. The sheet preferably comprises a coated hydrophobic bond paper sheet, or a printable plastic sheet, and the indicia includes fixed word indicia relating to fuel economy and price information for a motor vehicle, and also includes variable numerical indicia corresponding to and adjacent the fuel economy and price word indicia.

The repositional adhesive patterns typically comprise first and second strips of repositional adhesive adhered directly to the bond sheet, or repositional adhesive strips disposed on top of tape strips, the tape strips adhesively adhered to the bond sheet with permanent adhesive. If desired, patterns of repositional adhesive may also be disposed adjacent the third and fourth edges of the sheet, with release strips covering those patterns too.

The window sticker described above is formed from, in one embodiment a continuous web of printable material (e.g. coated hydrophobic bond paper, a plastic sheet, etc.) elongated in a first direction with the first and second opposite edges extending in the first direction. Means defining lines of weakness (e.g. perforations) are provided in a second direction, perpendicular to the first direction, to separate the web into individual stickers, with means defining tractor drive openings in the web adjacent the first and second opposite edges. Ultimately, the intermediates are burst along the lines of weakness to form individual stickers, and marginal portions containing the tractor drive openings are removed, for example by slitting.

According to another aspect of the present invention, a method of constructing a window sticker from a web of printable material (preferably coated hydrophobic bond paper, a plastic sheet, or the like) having first and second opposite edges elongated in a first direction, and first and second faces, is provided. The method comprises the following steps: (a) Feeding the continuous web in the first direction. (b) Printing fixed indicia on the first face of the web while practicing step (a). (c) Applying repositional adhesive patterns and covering release strips onto the first face adjacent the first and second edges while practicing step (a). Then, (d) printing variable indicia on the first face of the web, including adjacent fixed indicia. And, (e) separating the continuous web into individual window stickers having third and fourth edges perpendicular to the first and second edges.

Step (b) is practiced by printing fixed word indicia relating to fuel economy of a motor vehicle, and price information for that vehicle, while step (d) is preferably practiced with a continuous or sheet fed laser printer, to print variable numerical indicia corresponding to and adjacent the fuel economy and price word indicia. Step (c) is preferably practiced by tip-on or blow-on label techniques using double face label stock, although alternatively it may be practiced by providing a coating of repositional adhesive in strip form adjacent each of the first and second edges, and applying a release strip over each of the strips of repositional adhesive. Step (d) is preferably practiced before step (e), and step (b) is practiced before step (c).

In use of the window stickers, the release strips are removed from the repositional adhesive patterns, and the repositional adhesive is brought into contact with the inside surface of a motor vehicle window to hold the window sticker in place. The window sticker may be removed from the window and repositioned as desired. Once the motor vehicle is sold, the entire window sticker is removed from the motor vehicle, leaving no adhesive residue on the window, and the sticker is integral, and entirely readable, and may be maintained by a customer as a receipt (typically after cutting off the repositional adhesive strips with a scissors).

It is the primary object of the present invention to provide a versatile, simple, economical, and advantageous window sticker for motor vehicle pricing and fuel economy information. This and other objects of the invention will become clear from an inspection of the detailed description of invention, and from the appended claims.

DETAILED DESCRIPTION OF THE DRAWINGS

Figure 1:
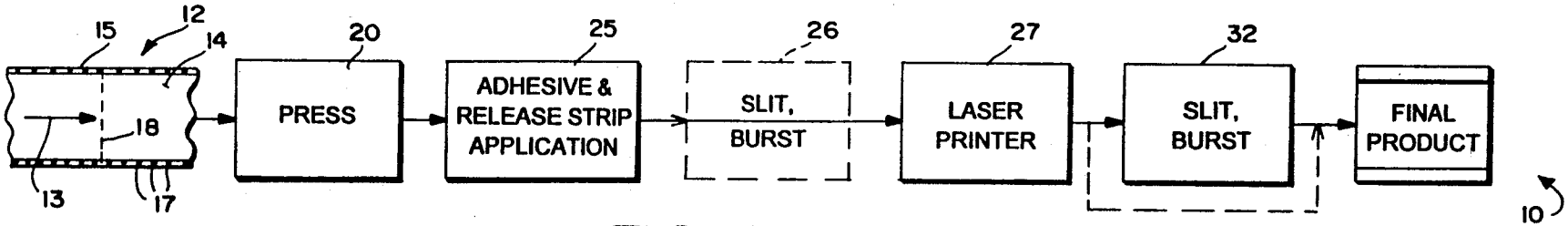
FIG. 1 is a flow chart showing an exemplary method according to the present invention.

FIG. 1 illustrates schematically exemplary method steps and/or equipment utilized in the practice of an exemplary method according to the present invention. According to the method of the present invention, a window sticker—shown schematically by reference numeral 10—is produced from a continuous web 12 of printable opaque, translucent, or perhaps transparent material, typically coated hydrophobic bond paper, or a plastic sheet such as printable polystyrene, polyolefin, polyethylene, polyester (e.g. Mylar), etc. about 5–12 mil thick, or composite material (e.g. a layered paper/plastic construction). The web 12 is elongated in a first direction 13 and has first and second faces including a first or top face 14 and a bottom face (not shown). Typically, it also includes first and second edges 15, 16 parallel to the first direction 13, and means defining tractor feed openings 17 adjacent each of the edges 15, 16, in marginal portions of the web 12. Lines of weakness, such as perforations 18, are provided at spaced locations along the web 12, perpendicular to the first direction 13, and dividing the web 12 into individual stickers useful in making the final window sticker 10.

In an exemplary method according to the present invention, the web 12 is fed in the first direction 13 by any conventional apparatus, such as feed rollers (not shown), to a conventional press 20 or the like. At the press 20, fixed word indicia is printed on the first face 14 of the web 12 as it is being fed in the first direction 13. The fixed word indicia includes indicia—shown at 22 in FIG. 2—which relates to fuel economy of a type of motor vehicle. The fixed indicia also includes word price indicia 23 (see FIG. 2) relating to that motor vehicle. The indicia 22, 23, will be of the type required by Federal, state, or local law, in conventional practice, such as listing the city and highway estimated fuel economy of the vehicle, the estimated annual fuel cost for comparison purposes, a list of options and the prices of options, a space for the total price in dollars, etc.

After printing of the fixed indicia 22, 23 on the web 12 by the press 20, the web 12 is fed to a station 25 where repositional adhesive patterns and covering release strips are applied onto the first face 14 adjacent the first and second edges 15, 16 (although inside of the tractor drive opening 17), the application of the repositional adhesive patterns and covering release strips also being practiced while the web 12 is moving in direction 13. Basically two different techniques may be utilized for practicing this method step. According to a first technique, label stock is applied by tip-on or blow-on techniques. The label stock may have repositional adhesive on both faces of a tape strip, with a release liner over the uppermost repositional adhesive portion, or it may have permanent adhesive on the bottom of the tape. One commercially available piece of equipment suitable for practicing this method step is the Quadre Transform/1800 Forms Labelling System made by QLS Incorporated of Eastlake, Ohio. Other equipment can also be used for that purpose, and the equipment itself is not part of the present invention.

As a second alternative to the practice of the method step at station 25 of FIG. 1, coating strips of repositional adhesive may be applied adjacent the edges 15, 16 (but inside the tractor drive openings 17), directly on the first face 14 of the web 12, and then covered by a release strip.

The repositional adhesive is of the type such as described in U.S. Pat. No. 4,882,211, the disclosure of which is hereby incorporated by reference herein. The adhesive may be that manufactured by 3M for use with its Post-It® products, or that manufactured by Moore Business Forms, Inc. for its Note-Stix® products, or other suitable repositional adhesives.

After passing through station 25, the web 12 may optionally be slit and burst at that point, as illustrated in dotted line by station 26. If slit and burst at that point, utilizing a conventional slitter for removing the marginal portions of the web 12 along the edges 15, 16 containing the tractor drive openings 17, and a conventional burster for bursting along the perforations 18, the forms will be fed to a sheet feed laser printer 27. If not burst at station 26, they will be fed to a continuous laser printer 27, such as Siemens ND2200 Cold Fusion Printer.

Normally the laser printer 27 is located at a different location than the press 20 and the adhesive application station 25, although it can be at the same location. Whether the forms are fed in continuous format or sheet fed format to the laser printer 27, the printer 27 prints variable indicia on the first face 14 including numerical indicia, such as indicia 29 illustrated in FIG. 2, corresponding to the fixed information fuel economy words, and variable numerical indicia 30 corresponding to the fixed indicia words regarding price. If printed in continuous format by the laser printer 27, the web 12 is then slit and burst at station 32, again utilizing a conventional slitter for slitting off the marginal portions (e.g. see 32 in FIG. 2) containing the tractor drive openings 17, and bursting the individual stickers from each other along the perforations 18. The final product 10 that is produced is illustrated in FIG. 2.

Figure 3:
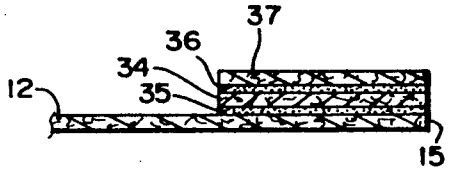
FIG. 3 is a detail cross-sectional view of one of the first or second edges of the window sticker of FIG. 2.
Figure 2:
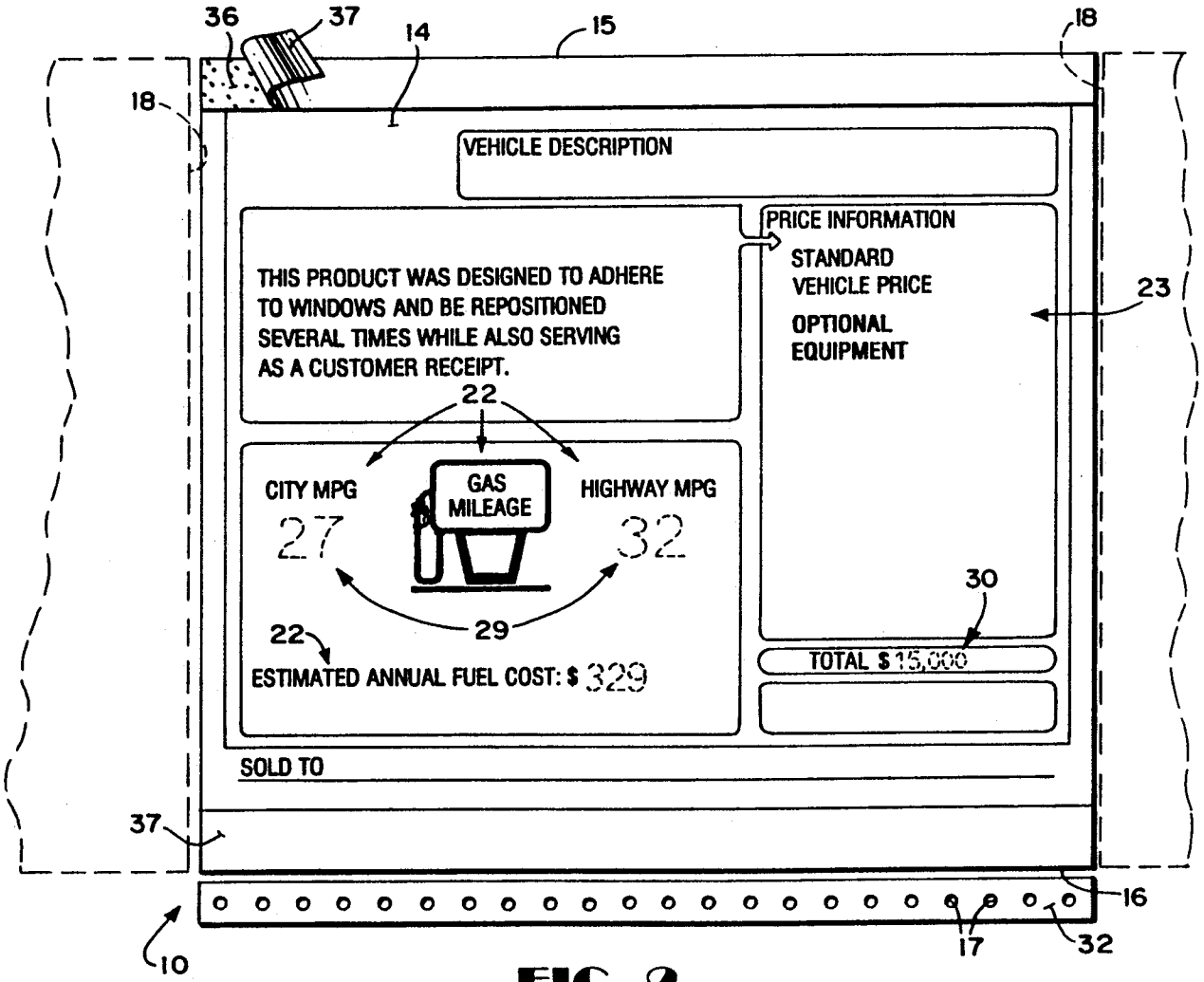
FIG. 2 is a top plan view of an exemplary window sticker according to the invention.

FIG. 3 illustrates an edge configuration (adjacent either edge 15 or 16) of the sticker 10 of FIG. 2 if tip-on or blow-on label techniques are utilized to apply adhesive along the edges, at station 25. Applied onto the label 12 is the tape 34 (label stock) having an adhesive 35 on one face thereof which becomes adhesively secured to the paper web 12, and adhesive 36 on the other face thereof which faces upwardly, and is covered by a release liner 37 of typical release material. The adhesive 35 may either be permanent adhesive or repositional adhesive, while the adhesive 36 is repositional adhesive.

Figure 4:
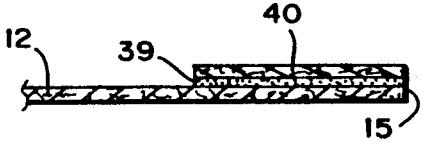
FIG. 4 is a view like that of FIG. 3 only for an alternative embodiment.

FIG. 4 is a view like that of FIG. 3 only showing a different construction of the adhesive. In this case, a coating 39 of repositional adhesive was applied directly to the coated hydrophobic paper web 12, with a release liner 40 covering the repositional adhesive 39.

Figure 5:
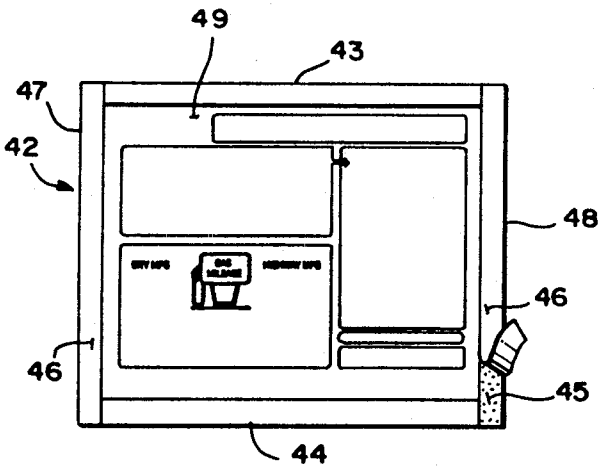
FIG. 5 is a top plan view of another alternative embodiment of a sticker according to the invention.

FIG. 5 shows another modification of a window sticker according to the present invention, illustrated generally by reference numeral 42. In this embodiment the only significant differences are that in addition to the strips or other patterns of repositional adhesive disposed along the first and second edges (the longitudinal edges in the direction of movement 13 of the web 12, and the top and bottom edges in the final sticker 10), repositional adhesive strips or other patterns 45, with protective release liners 46, are also disposed along third and fourth edges 47, 48 of the form 42, on the first face 49 thereof (the face containing the fixed and variable printing indicia).

Figure 6:
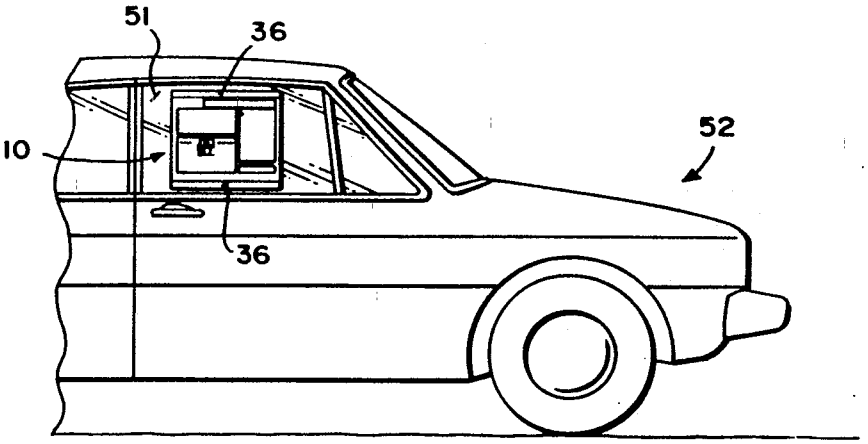
FIG. 6 is a schematic side view showing a sticker according to the invention in use on a motor vehicle window.

FIG. 6 illustrates a manner of use of the window sticker 10 according to the invention. Utilization of the window sticker 10 is extremely simple. All one does is remove the release liners 37 covering the repositional adhesive strips or other patterns 36 at the top and bottom edges 15, 16 of the sticker 10, and then places those strips of repositional adhesive 36 into contact with the interior surface of a window 51 of a motor vehicle, such as automobile 52. The sticker 10 may be removed from the window 51 and repositioned as desired, the repositional adhesive 36 allowing this. Once the motor vehicle 52 is sold, the sticker 10 is removed, and since it is entirely integral and in readable form, it may be maintained by the customer as a receipt. If the customer does this, typically the customer would cut off the strips of adhesive 36 with a scissors or the like, or the web 12 could be constructed so that there were perforations or other lines of weakness parallel to the first and second edges 15, 16 just inside the strips 36. When the sticker 10 is removed from the window 51, no adhesive residue remains.

It will thus be seen that according to the present invention an advantageous window sticker, particularly for use with a motor vehicle, has been provided which is simple and inexpensive to construct and simple to utilize. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A window sticker comprising:

a sheet of printable material having first and second faces, and opposite first and second edges, and opposite third and forth edges;

indicia printed on said first face including fixed word indicia relating to fuel economy of a motor vehicle, and price information for that motor vehicle;

repositional adhesive patterns disposed on said first face adjacent said first and second edges, said repositional adhesive patterns comprise repositional adhesive strips disposed on top of tape strips, the tape strips adhesively adhered to a sheet of opaque material with permanent adhesive; and release strips covering said repositional adhesive patterns, and removable to expose said repositional adhesive.

2. A window sticker as recited in claim 1 wherein said sheet of printable material comprises opaque sheet material.

3. A window sticker as recited in claim 2 further comprising patterns of repositional adhesive disposed adjacent said third and fourth edges of said sheet, and release strips covering said patterns.

4. A window sticker as recited in claim 1 wherein said sheet of printable material is selected from the group consisting essentially of coated hydrophobic bond paper, opaque plastic, translucent plastic, and transparent plastic.

5. A window sticker intermediate as recited in claim 1 wherein said web of printable material comprises a web of material selected from the group consisting essentially of hydrophobic coated bond paper, and plastic sheets about 5–12 mil thick.

6. A method of constructing a window sticker from a continuing web of printable material having first and second opposite edges elongated in a first direction, and first and second faces, comprising the steps of:

(a) feeding the continuous web in the first direction;

(b) printing fixed indicia on the first face of the web while practicing step (a);

(c) applying repositional adhesive patterns and covering release strips onto the first face adjacent the first and second edges while practicing step (a); then (d) printing variable indicia on the first face of the web, including adjacent fixed indicia; and (e) separating the continuous web into individual window stickers having third and fourth edges perpendicular to the first and second edges.

7. A method as recited in claim 6 wherein step (b) is practiced by printing fixed word indicia relating to fuel economy and price information for a motor vehicle.

8. A method as recited in claim 7 wherein step (d) is practiced with a laser printer to print variable numerical indicia corresponding to and adjacent the fuel economy and price word fixed indicia.

9. A method as recited in claim 6 wherein step (c) is practiced by tip-on or blow-on label techniques using double faced adhesive label stock.

10. A method as recited in claim 6 wherein step (c) is practiced by providing a coating of repositional adhesive in strip form adjacent each of the first and second edges, and applying a release strip over each of the strips of repositional adhesive.

11. A method as recited in claim 6 wherein step (d) is practiced before step (e), and step (b) is practiced before step (c).

12. A method as recited in claim 6 wherein the web is of bond paper having lines of weakness formed therein perpendicular to the first direction; and wherein step (e) is practiced by bursting the web at the lines of weakness.

13. A method as recited in claim 12 wherein the web includes tractor drive openings formed in marginal portions along the first and second edges, closer to the edges than the patterns of repositional adhesive, and comprising the further step (f) of removing the marginal portions from the web.

14. A method as recited in claim 13 wherein step (f) is practiced by slitting the web between the marginal portions and the repositional adhesive patterns.

15. A method as recited in claim 8, comprising the further step of removing the release strips from the repositional adhesive patterns; and bringing the repositional adhesive patterns into contact with the inside surface of a motor vehicle window to hold the window sticker in place.

16. A method as recited in claim 15 comprising the further step of removing the window sticker from the motor vehicle window, and repositioning it, as desired.

17. A method as recited in claim 16 comprising the further step of entirely removing the window sticker from the motor vehicle window, leaving no adhesive residue on the window, and retaining the sticker in integral, readable form, as a receipt.

18. A window sticker, comprising:

a sheet of printable material having first and second faces, and opposite first and second edges, and opposite third and fourth edges;

indicia printed on said first face;

repositional adhesive patterns disposed on said first face adjacent said first and second edges; and release strips covering said repositional adhesive patterns, and removable to expose said repositional adhesive;

wherein said repositional adhesive patterns comprise repositional adhesive strips disposed on top of tape strips, the tape strips adhesively adhered to said sheet of opaque material with permanent or repositional adhesive.

* * * * *

UNITED STATES PATENT AND TRADEMARK OFFICE

CERTIFICATE OF CORRECTION

PATENT NO. : 5,290,067
DATED : March 1, 1994
INVENTOR(S) : Joseph W. Langan

It is certified that error appears in the above-indentified patent and that said Letters Patent is hereby corrected as shown below:

On the Title Page, Item [75], the invenor's name should read;

--Joseph W. LANGAN--

Signed and Sealed this

Twenty-first Day of June, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,290,067
DATED : March 1, 1994
INVENTOR(S) : Joseph W. Langan

It is certified that error appears in the above-identified patent and that said Letters Patent is hereby corrected as shown below:

Title page,
Item [75], Inventors, please change "Joseph W. Langen" to -- Joseph W. Langan --

Signed and Sealed this

Third Day of December, 2002

JAMES E. ROGAN
*Director of the United States Patent and Trademark Office*